United States Patent [19]

Hastings et al.

[11] Patent Number: 4,750,631

[45] Date of Patent: Jun. 14, 1988

[54] ANTI-SLOSH APPARATUS FOR LIQUID CONTAINERS

[75] Inventors: Roger N. Hastings, Burnsville; John A. Imsdahl, Richfield, both of Minn.

[73] Assignee: Sperry Corporation, Blue Bell, Pa.

[21] Appl. No.: 887,667

[22] Filed: Jul. 21, 1986

[51] Int. Cl.[4] ..... B65D 25/00

[52] U.S. Cl. ..... 220/21; 220/22; 220/5 A; 220/85 S; 220/88 R; 220/90.4

[58] Field of Search ..... 220/22, 21, 85 S, 88 R, 220/90.4, 5 A

[56] References Cited

U.S. PATENT DOCUMENTS

| | | | |
|---|---|---|---|
| 2,792,962 | 5/1957 | Granfelt | 220/21 |
| 2,850,083 | 9/1958 | Frost | 220/88 R |
| 3,069,042 | 12/1962 | Johnston | 220/10 |
| 3,246,789 | 4/1966 | Progler | 220/15 |
| 3,414,155 | 12/1968 | Corvino | 220/5 |
| 3,441,164 | 4/1969 | Wang | 220/9 |
| 3,602,391 | 8/1971 | Tramontini | 220/71 |
| 3,979,005 | 9/1976 | Robinson et al. | 220/22 X |
| 4,013,190 | 3/1977 | Wiggins et al. | 220/22 |
| 4,294,279 | 10/1981 | Wyeth | 220/85 S X |
| 4,566,589 | 1/1986 | Poschinger | 206/0.6 |

*Primary Examiner*—Steven M. Pollard

*Attorney, Agent, or Firm*—John B. Sowell; James R. Bell; L. Joseph Marhoefer

[57] ABSTRACT

In order to avoid the sloshing of liquid within a container caused by movement of the container, the single bulk volume of the liquid is retained in the form of a plurality of separated mini-volumes. This is accomplished by providing a chamber formed by upper and lower plates and an interconnecting sidewall. A plurality of elongated, adjacent mini-chambers are provided within the chamber aligned in side-by-side relationship with the sidewall. The mini-chambers are formed by a honeycomb medium of acoustical material having one end sealed closed. The medium has no measurable magnetic susceptability and is formed of a paper material treated with a heat resistant phenolic resin. When placed within an insulated housing including isothermal shields, the chamber is useful in cryogenic applications such as, for example, storing liquid helium.

10 Claims, 2 Drawing Sheets

ANTI-SLOSH APPARATUS FOR LIQUID CONTAINERS

BACKGROUND OF THE INVENTION

1. Field of the Invention

This invention relates generally to receptacles for containing liquids and more particularly to those of the cryogenic type including apparatus for limiting the sloshing of liquid contained therein.

2. Background Description

In cryogenic applications, liquid helium is used as a coolant, and in particular for superconductivity such as in computer technology. Generally, the helium is contained in a reservoir within a vacuum bottle or dewar. In many applications it is desirable to mechanically contain the helium so that it does not slosh around within the reservoir. Sloshing helium causes increased boil-off leading to shorter hold times, and creates temperature fluctuations which are often undesirable.

In magnetic sensing applications, the sloshing heluim creates a magnetic signal due to its slight diamagnetic susceptability. Past attempts to arrest the motions of the helium have involved using plates, tubes and foams as baffles within the reservoir. These attempts are limited as follows: the baffling material displaces liquid helium so that the resulting smaller volume of helium leads to a shorter hold time; in magnetic sensor applications, non-magnetic materials must be used which are quite expensive; and the extremely low viscosity of liquid helium allows the bulk fluid to seek its own gravitational level surface in spite of the presence of the baffling materials.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an anti-slosh apparatus for liquid containers including a chamber formed by first and second spaced apart members and an interconnecting sidewall. Means are provided within the chamber for limiting sloshing action of a liquid therein in response to the chamber being moved. Such means includes a honeycomb core having a plurality of elongated, adjacent mini-chambers aligned in side-by-side relationship within the chamber. The mini-chambers have one end sealed closed and the opposite open end extends toward the second member.

The foregoing and other aspects will become apparent from the following detailed description of the invention when considered in conjunction with the accompanying drawing. It is to be expressly understood, however, that the drawing is not intended as a definition of the invention but is for the purpose of illustrating only.

DESCRIPTION OF THE PREFERRED EMBODIMENT

Figure 1:
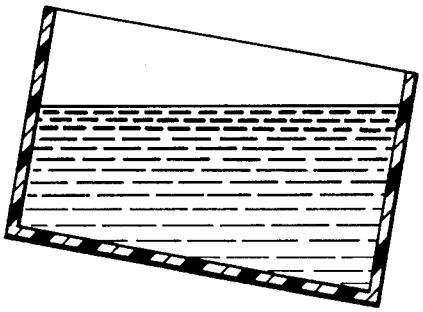
FIG. 1 is a side elevational view illustrating an embodiment of a tilted liquid container and the resulting bulk change in the liquid level.
Figure 2:
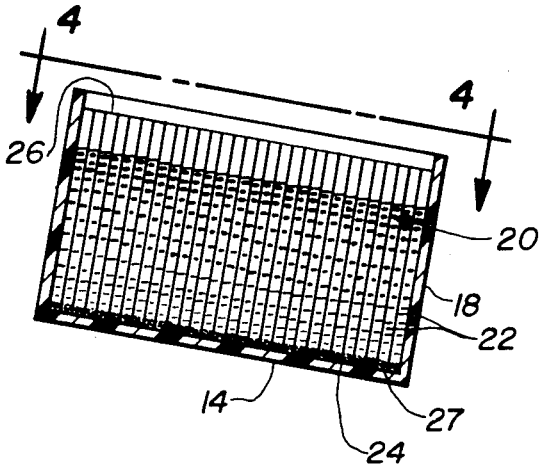
FIG. 2 is a side elevational view illustrating an embodiment of a tilted liquid container including a plurality of individual liquid chambers resulting in miniscule bulk change in the liquid level.
Figure 4:
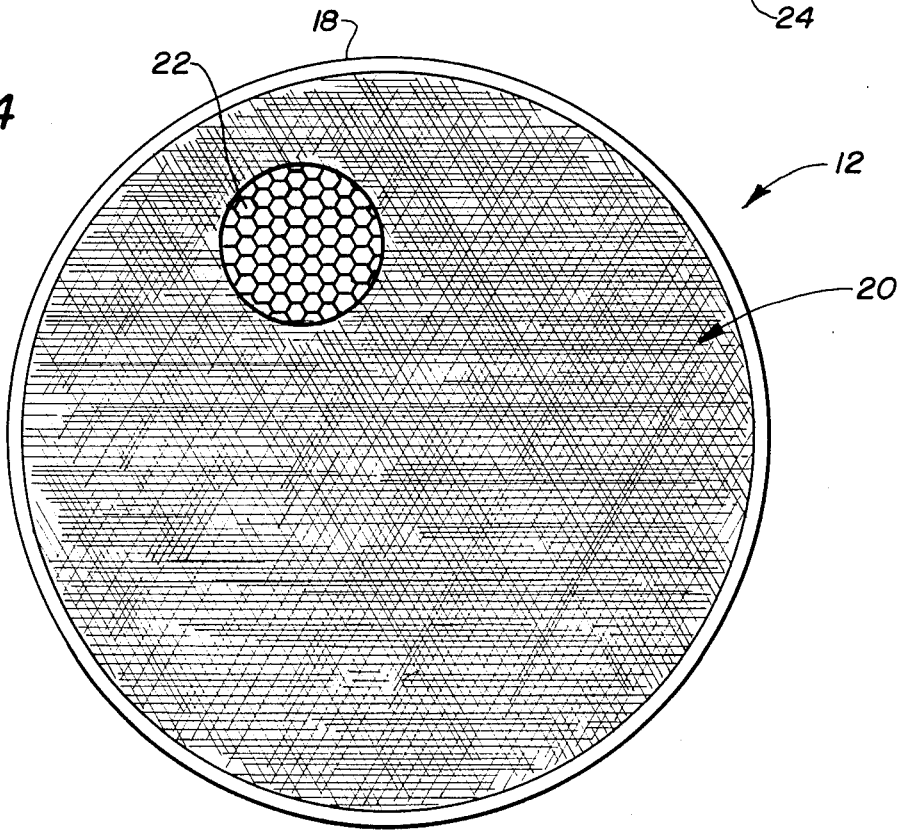
FIG. 4 is a partial cross-sectional view taken along the line 4—4 of FIG. 2, and includes an exploded view of a honeycomb medium.

Liquid stored in a container will slosh around in response to movement or tilting of the container. As a result, the bulk level of the liquid will change if the liquid motion is not limited as illustrated in FIG. 1. However, FIG. 2 illustrates that the bulk level change of a liquid in a tilted container can be effectively limited.

Figure 3:
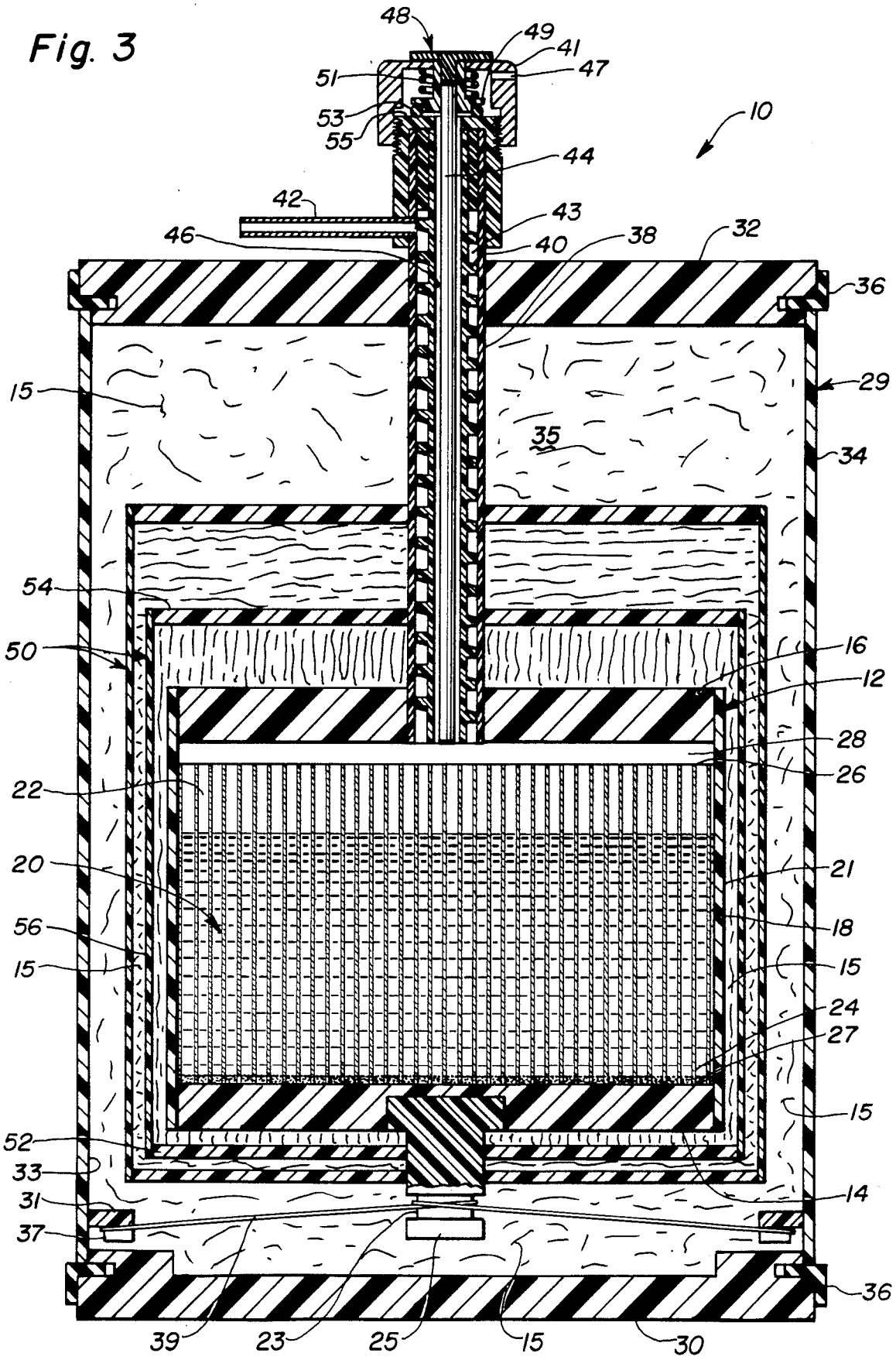
FIG. 3 is a side elevational view illustrating an embodiment of the anti-slosh apparatus of this invention.

An effective anti-slosh apparatus for liquid containers is illustrated in FIG. 3 and is generally designated 10. Apparatus 10 includes a cylindrical chamber 12 defined by a first plate member 14 spaced apart from a second plate member 16 by an interconnecting tubular sidewall 18. Members 14, 16 and sidewall 18 are preferably formed by fiberglass and are joined together by a suitable means such as epoxy. Outer wall 21 of chamber 12 is wrapped with a well-known material 15 known as superinsulation.

Within chamber 12 are means such as an anti-sloshing medium 20 in the form of a plurality of elongated, adjacent mini-chambers 22 aligned in side-by-side relationship with sidewall 18. Medium 20 is preferably formed of a honeycomb core of aramid-fiber paper, primarily used as an acoustical material, treated with a heat resistant phenolic resin and sold under the trademark NOMEX by the DuPont Company of Wilmington, Del. This product features high strength and toughness in a small cell size, low density, non-metallic core. The honeycomb core is available in the form of a plurality of mini-chambers of hexagonal cross-section wherein each mini-chamber 22 has a maximum dimension of ⅛ inches. It has been found, according to this invention, that this honeycomb material can be used as an anti-sloshing baffle for liquid helium. The medium 20 is cut into a cylindrical shape to fit tightly within chamber 12. One end 24 of medium 20 is closed by being sealed with a suitable adhesive such as an epoxy 27. The other end 26 of medium 20 is open and extends toward second member 16. A space designated 28 is defined between end 26 and member 16. This space is a non-critical dimension of about 0.3 inches and is provided to permit dispersement of helium into mini-chambers 22 during filling of chamber 12. Of course it would be possible to form a similar medium of other materials or by a plurality of individual mini-chambers stacked within chamber 12 in side-by-side relationship and sealed at one end in some manner or in the manner described above. The non-metallic medium 20 has no measurable magnetic susceptability when measured with a sensitive instrument. Pressure within helium filled chamber 12 is slightly above 1 atmosphere.

A housing 29 is preferably cylindrical and is formed of a first plate member 30 spaced apart from a second plate member 32 by an interconnecting tubular sidewall 34. Members 30, 32 and sidewall 34 are preferably formed of fiberglass and are held together due to a pressure differential which varies from atmospheric pressure outside housing 29 to a vacuum or negative pressure in the space designated 35 within housing 29.

Space 35 is generally filled with additional amounts of superinsulation 15. A suitable seal such as a bell jar gasket 36, is used at the joinder of sidewall 34 and plates 30, 32, respectively.

A neck portion 38 extends from member 16 through member 32. Neck portion 38 is tubular and provides four separate functions for chamber 12. First, by means of a fluid path 43 formed by spiral member 40, gas is permitted to escape from chamber 12 via a brass vent 42. Second, with a cap 41 and an attached rod 44 removed from an opening 46 in spiral member 40, helium chamber 12 can be filled from outside housing 29. Third, with rod 44 reinserted into opening 46 and cap 41 threaded onto neck portion 38, opening 46 is essentially plugged to limit room temperature heat from passing from outside housing 29 to within the −452° F. helium filled chamber 12. Fourth and last, should pressure within chamber 12 reach a potentially explosive level, a well known, spring-loaded pressure relief valve 48 is provided in cap 41 to relieve excessive pressure as required. Valve 48 operates by virtue of rod 44 and a poppet 49 being forced upwardly against an opposing force exerted by a spring 51 which seats an "O" ring 53 against a seat 55. Pressure is thus admitted from chamber 12 via passage 46 into cap 41 and released through one of a plurality of holes 47 formed in cap 41.

At least one isothermal shield 50 is mounted between chamber 12 and housing 29. Although two shields 50 are shown, only one is described since they differ only in relative size. Together, housing 29, shield 50 and chamber 12 form a nest of progressively varying size, concentrically arranged cylinders. First and second plate members 52, 54, respectively, of shield 50 are held in spaced apart relationship by a tubular sidewall 56. Member 52 is formed of fiberglass impregnated with a commercially available material known as litz wire. Sidewall 56 and member 54 are formed of fiberglass. The entire outer surface of shield 50 is enclosed with a highly thermally conductive material glued only to member 54. The material is preferably a sheet formed of high purity copper wire strands, each strand having a diameter of about 0.003 inches. The sheet is oriented to be anisotropically conductive in the longitudinal direction of shield 50. Outside of this highly thermally conductive material, shield 50 is further enclosed in superinsulation 15 as described above for 12. Additional shields may be used if desired, each being formed as shield 50 and each being concentrically mounted in nested fashion with respect to chamber 12, shield 50 and housing 29. Neck portion 38 extends through second member 54 of shield 50 and, if additional shields are used, neck portion 38 would extend through each in a similar manner.

A fiberglass ring 31 is fastened by a suitable means, such as an epoxy, to an inside surface 33 of sidewall 34. Ring 31 is of a construction sufficient to provide an annular lip 37 adjacent surface 33. A fiberglass stabilizer member 25 is similarly fastened to member 14 of chamber 12. Stabilizer 25 extends through member 52 of shield, or possibly shields, 50. An annular groove 23 is formed in stabilizer 25. A dacron cord 39 is attached to ring 31 via lip 37. Cord 39 extends from lip 37 to groove 23 of stabilizer 25. It is preferred that a plurality of strands of cord 39 will be thus attached between stabilizer 25 and various points on lip 37 in order to stabilize and limit movement of chamber 12 within housing 29 since chamber 12 is otherwise cantilevered from member 32 of housing 29 via neck portion 38.

The foregoing has described the use of an acoustic honeycomb material as a slosh baffle for liquid helium chambers. The material includes a plurality of elongated mini-chambers in side-by-side relationship. Sloshing of the helium is avoided. No bulk level change is realized due to confinement of the liquid to the separate mini-chambers. This limits boil-off of the liquid helium and increases hold time. Also, magnetic signals often produced by sloshing helium are avoided. The honeycomb material displaces very little liquid helium and thus contributes further to increased hold time. The material used no measurable magnetic susceptability and is relatively inexpensive when compared to other materials which have been used as slosh baffles. Other possible applications include confinement of liquid in vehicles such as trucks, trains, etc. where sloshing liquid can create a problem. Exemplary candidate liquids which are typically transported by such vehicles include hydrogen, oxygen, nitrogen, gasoline and milk.

Having thus described the invention, what is claimed is:

1. Anti-slosh apparatus for cryogenic containers of the type having an inner liquid chamber and an outer insulating housing, comprising:

a bottle shaped container having substantially vertical continuous sidewalls defining said inner liquid chamber located inside said insulating housing, a top closure plate connected to said vertical sidewalls, a bottom closure plate connected to said vertical sidewalls, inlet-outlet means connected through said top closure plate and extending through said insulating housing forming a passageway into said inner liquid chamber, cellular anti-sloshing means comprising a plurality of individual mini-chambers inside said inner liquid chamber formed as a honeycomb core sealed closed at said bottom closure plate, and each said individual honeycomb shaped mini-chamber being formed as an independent and isolated vertical container open only at the top and isolated from adjacent mini-chambers so that tilting and sloshing of the liquid in each mini-chamber is independent of and unrelated to tilting and sloshing in adjacent mini-chambers.

2. The apparatus of claim 1 wherein said means for limiting sloshing are formed of a material having no measurable magnetic susceptability.

3. The apparatus of claim 1 wherein said means for limiting sloshing are formed of a paper material treated with a heat-resistant, phenolic resin.

4. The apparatus of claim 1 including:

at least one isothermal shield mounted between said inner liquid chamber and said outer insulating housing.

5. The apparatus of claim 4 including:

insulating material between said inner liquid chamber and said shield and between said shield and said housing.

6. The apparatus of claim 5 including:

a stabilizer member connected to said bottom closure plate.

7. The apparatus of claim 6, including:

a neck portion connected to said top closure plate defining a fluid communication port between said chamber and outside said housing.

8. A cryogenic liquid receptacle having an anti-sloshing apparatus therein, comprising:

an enclosed housing;

at least one isothermal shield mounted within said housing;

a chamber formed by first and second spaced apart members interconnected by a sidewall, said chamber being mounted within said shield;

an insulating material between said chamber and said shield and between said shield and said housing;

a stabilizer connected to said first member and extending in a first direction;

a neck portion connected to said second member and extending outside said housing in a second direction, said neck portion defining a fluid communication port extending from inside said chamber to outside said housing; and a plurality of elongated, adjacent mini-chambers aligned in side-by-side relationship with said sidewall, said mini-chambers having one end adjacent said first member sealed closed and a second end open and extending toward said second member forming individual liquid containers.

9. The container of claim 8 wherein said mini-chambers are formed of a material having no measurable magnetic susceptability.

10. The receptacle of claim 8 wherein said mini-chambers are formed of a paper material treated with a heat-resistant, phenolic resin.

* * * * *

UNITED STATES PATENT AND TRADEMARK OFFICE

CERTIFICATE OF CORRECTION

PATENT NO. : 4,750,631

DATED : June 14, 1988

INVENTOR(S) : Roger N. Hastings, John A. Imsdahl

It is certified that error appears in the above-identified patent and that said Letters Patent are hereby corrected as shown below: On the title page The following name should be added as an inventor on the cover of the patent -- Raymond J. Schneider of Herndon, Virginia -- .

Signed and Sealed this

Seventeenth Day of January, 1989

*Attest:*

DONALD J. QUIGG

*Attesting Officer*

*Commissioner of Patents and Trademarks*